US007271738B2

(12) United States Patent
Berstis et al.

(10) Patent No.: US 7,271,738 B2
(45) Date of Patent: Sep. 18, 2007

(54) RESTRICTED PARKING SYSTEM

(75) Inventors: Viktors Berstis, Austin, TX (US); Michael Pierre Carlson, Austin, TX (US); Samuel Roy Detweiler, Cedar Park, TX (US); Randolph Michael Forlenza, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 221 days.

(21) Appl. No.: 11/104,048

(22) Filed: Apr. 12, 2005

(65) Prior Publication Data

US 2006/0227010 A1 Oct. 12, 2006

(51) Int. Cl.
*G08G 1/14* (2006.01)

(52) U.S. Cl. ..... 340/932.2; 340/933; 340/937; 340/942; 340/995.1; 340/904; 340/905

(58) Field of Classification Search ..... 340/932.2, 340/933, 937, 942, 995.1, 904, 905
See application file for complete search history.

(56) References Cited

U.S. PATENT DOCUMENTS 5,153,586 A * 10/1992 Fuller ..... 340/932.2
5,442,348 A * 8/1995 Mushell ..... 340/932.2
5,995,898 A 11/1999 Tuttle ..... 701/102
6,112,152 A 8/2000 Tuttle ..... 701/115
6,646,568 B2 11/2003 MacPhail et al. ..... 340/932.2
7,019,670 B2 * 3/2006 Bahar ..... 340/932.2
2002/0077953 A1 6/2002 Dutta ..... 705/37
2004/0254840 A1 12/2004 Slemmer et al. ..... 705/22
2005/0229451 A1 * 10/2005 Mullens et al. ..... 40/500

FOREIGN PATENT DOCUMENTS

EP 0725377 A2 7/1996

* cited by examiner

*Primary Examiner*—Tai Nguyen
(74) *Attorney, Agent, or Firm*—David A. Mims, Jr.; Robert V. Wilder

(57) ABSTRACT

A method and implementing computer system are provided for enabling management of restricted parking spaces for vehicles. In an example, a sensing system senses the presence of vehicles in predetermined parking spaces and stores that information for subsequent processing. Particular parking restrictions, or limited parking indicia, for given parking spaces are displayed and viewable to vehicle operators. The posted parking restriction indicia are selectively changeable to accommodate various parking demand situations. The displayed limited parking indicia may be changed from one type of limited parking to other types of limited (or unlimited) parking from a remote server location, either selectively by an administrator or in accordance with a stored parking authorization plan or schedule. Vehicles are scanned for proper authorization for predetermined types of parking spaces. Alarms or other notification processes are implemented to provide notification of unauthorized vehicles which are parked in restricted parking spaces.

20 Claims, 5 Drawing Sheets

| DAY | 4-4-05 | | | | |
|---|---|---|---|---|---|
| TIME | 0000-0430 | 0430-0900 | 0900-1100 | ·····▶ | 1900-0000 |
| UNRESTRICTED | P1-P3; P6-P9 | NONE | NONE | ·····▶ | NONE |
| HANDICAPPED | P4-P5 | P4-P5 | P3-P6 | ·····▶ | P4-P5 |
| SHORT TERM | NONE | P2-P3; P6-P9 | P1-P2; P7-P9 | ·····▶ | P2-P3; P6-P9 |
| TIME LIMIT | NONE | 50 MIN. | 60 MIN. | ·····▶ | 90 MIN. |
| RESERVED | NONE | P1 | NONE | ·····▶ | P1 |
| SET ALARMS | NO | YES | NO | ·····▶ | YES |

APPLY SCHEDULED RESTRICTIONS EXIT AND APPLY DEFAULT SCHEDULE EXIT W/O CHANGE

401

*FIG. 4*

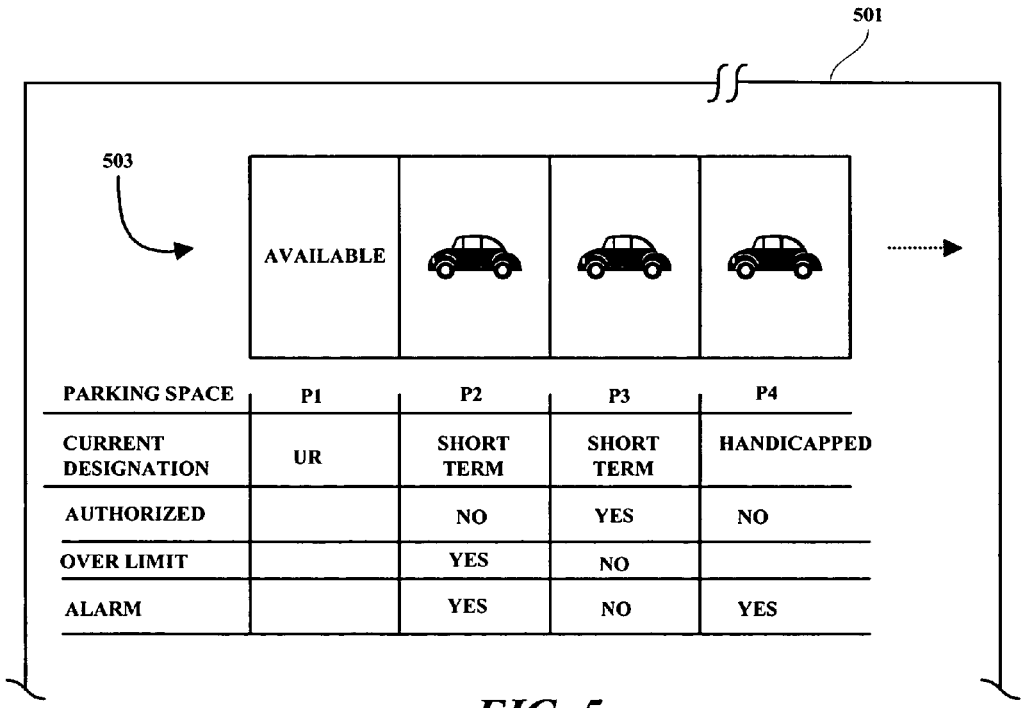

| PARKING SPACE | P1 | P2 | P3 | P4 |
|---|---|---|---|---|
| CURRENT DESIGNATION | UR | SHORT TERM | SHORT TERM | HANDICAPPED |
| AUTHORIZED | | NO | YES | NO |
| OVER LIMIT | | YES | NO | |
| ALARM | | YES | NO | YES |

*FIG. 5*

RESTRICTED PARKING SYSTEM

FIELD OF THE INVENTION

The present invention relates generally to information processing systems and more particularly to a methodology and implementation for enabling control of restricted parking spaces.

BACKGROUND OF THE INVENTION

The allocation, assignment and enforcement of restricted parking spaces in public and private parking lots is a significant challenge to vehicle operators as well as lot owners. People often park their vehicles in places that are restricted to limited or protected use, and there are often no police or other authorities around to enforce the parking rules. For example, a car may park in a handicapped zone even though it has no authorization to do so. An aggravating factor is that there may be too many or too few restricted (i.e. handicapped, short-term, etc.) parking spaces to adequately service the need at any particular point in time. Further, a set of parking spaces maybe reserved by painted lines or signs permanently when they are only needed during specific times or events. This causes aggravation for the public, especially if they drive by and see a large number of open, reserved spaces when they cannot find other places to park. For example, if too many reserved spaces around a building are empty and the only regular open parking spaces are located at a significant distance away, people are more prone to ignore posted signs and warnings and violate the posted parking restrictions by occupying restricted parking spaces. Conversely, if an inadequate number of spaces are allocated, people who truly require close proximity to the building will not be able to find an appropriate parking space. Thus, needs may vary according to time and events, but painted lines and posted signs are inflexible.

Thus, there is a need for an improved methodology and system for enabling a selective and/or automatic adjustment of the number of handicapped (or other) reserved parking spaces such that there are always a minimum number of reserved spaces available, but the number of reserved spaces will fluctuate according to immediate demand.

SUMMARY OF THE INVENTION

A method and implementing computer system are provided for enabling management of restricted parking spaces for vehicles. In an example, a sensing system senses the presence of vehicles in predetermined parking spaces and stores that information for subsequent processing. Particular parking restrictions, or limited parking indicia, for given parking spaces are displayed and viewable to vehicle operators. The posted parking restriction indicia are selectively changeable to accommodate various parking demand situations. The displayed limited parking indicia may be changed from one type of limited parking to other types of limited (or unlimited) parking from a remote server location, either selectively by an administrator or in accordance with a stored parking authorization plan or schedule. Vehicles are scanned for proper authorization for predetermined types of parking spaces, and alarms or other notification processes are implemented to provide notification of unauthorized vehicles which are parked in restricted parking spaces.

BRIEF DESCRIPTION OF THE DRAWINGS

A better understanding of the present invention can be obtained when the following detailed description of a preferred embodiment is considered in conjunction with the following drawings, in which:

FIG. 4 is an example of a programmable database schedule which may be implemented in accordance with the present invention;

FIG. 5 is an illustration of a status display which may be presented on a display device to show current status of vehicle parking in a controlled parking system;

DETAILED DESCRIPTION

Figure 1:
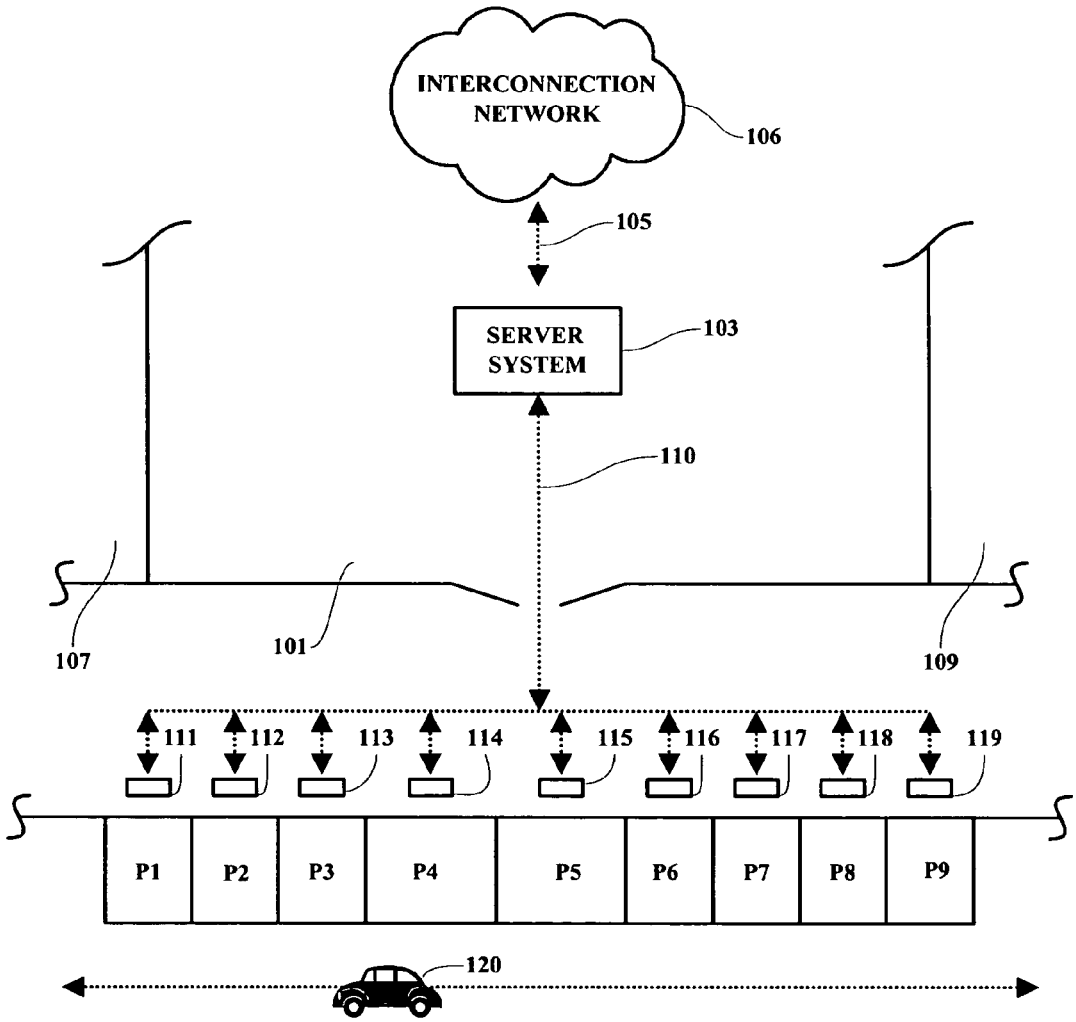
FIG. 1 is an illustration of a one embodiment of a parking system in accordance with the present invention.

It is noted that circuits and devices which are shown in block form in the drawings are generally known to those skilled in the art, and are not specified to any greater extent than that considered necessary as illustrated, for the understanding and appreciation of the underlying concepts of the present invention and in order not to obfuscate or distract from the teachings of the present invention.

The various methods discussed herein may be implemented in any processing system configured in accordance with the methods discussed herein. Such systems may be implemented within a stand-alone computer server system or over a computer network. A networked system may include a server, one or more computer terminals, and one or more remote display devices for displaying a restricted condition of a parking space. The present invention may be implemented using computer terminals which may comprise devices such as workstations, personal computers (PC) or laptop computers. Moreover, parking restrictions applicable to particular parking spaces may be viewable by vehicle operators by viewing a changeable display at the location of the parking space or by viewing a display presented on a wireless computer system or other device which has word processing capabilities, including but not limited to cellular or wireless telephone devices and personal digital assistants (PDAs). In general, an implementing computer system may include any computer system and may be implemented with one or several processors in a wireless system or a hard-wired multi-bus system, or within a network of similar systems.

As shown in FIG. 1, a department store 101, for example, includes a server system 103 which is coupled 105 to an interconnection network 106 such as the Internet, for connection to other server systems. Such a connection may be used for example in transmitting scanned license plate numbers or other designations to local or national authorities for parking authorization verification or to communicate with parking systems in other stores 107, 109 in a shopping center. The server system 103 is coupled 110 to a plurality of display devices 111-119 which are operable to present a display which is viewable by passing motorists 120. Each of the display devices 111-119 is assigned to and also viewable from a corresponding parking space P1-P9, respectively.

The server system 103 is operable to generate and provide display information which is displayed on the display devices 111-119.

Figure 2:
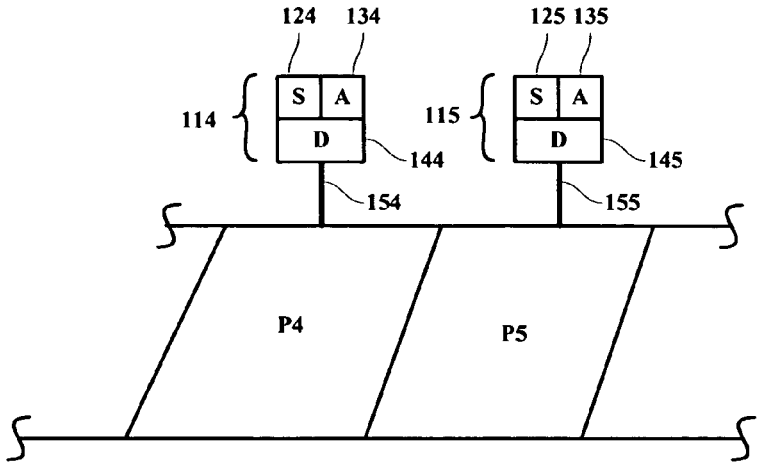
FIG. 2 is an illustration showing one embodiment of a display device which may be used with the present invention.

In FIG. 2, two of the parking spaces P4 and P5 are illustrated in more detail. As shown, each parking space P4 and P5 has a corresponding viewable display 114 and 115, respectively, which are coupled to the system server 103. In the example, each display includes, inter alia, a sensing function 124/125 for sensing the presence of a vehicle, an alarm function 134/135 for selectively sounding an alarm, and a display function 144/145 for selectively displaying parking restrictions associated with the corresponding parking slot P4/P5. For example, the display devices will display restrictions such as "HANDICAPPED PARKING ONLY", or "SHORT-TERM PARKING ONLY" or "UNLIMITED PARKING" or "OPEN PARKING". Other information may also be displayed such as what kind of handicapped authorization is necessary to park in one of the handicapped spaces or what the time limit for the short-term parking is. Additionally, a timer may be displayed which shows how much authorized time remains for vehicles parked in the short-term or handicapped slots. Other general information may also be displayed such as how to re-claim a towed vehicle. The FIG. 2 example illustrates one method of displaying restricted parking status of designated parking spaces but other methods may also be implemented. For example, the system server 103 may provide a home page which may be accessed by wireless display devices owned by vehicle operators to display current occupancy and restriction status of parking slots and/or even time remaining for occupied parking slots.

Figure 3:
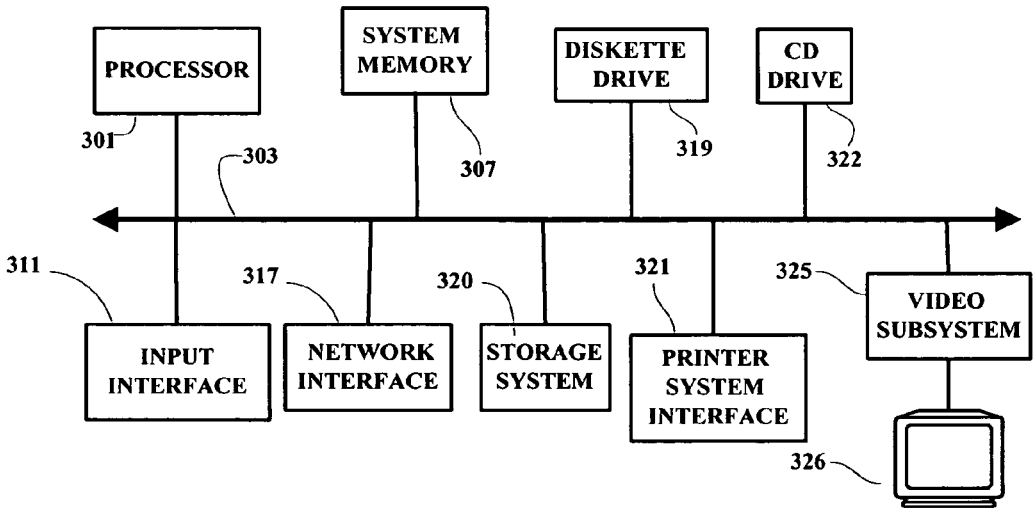
FIG. 3 is a block diagram of a server system which may be used in an implementation of the present invention.

FIG. 3 shows an exemplary block diagram for the system server 103. As shown, the system includes a processor 301 which is coupled to a system bus 303. The system also includes system memory 307, a diskette drive 319, a CD drive 322, an input interface 311, a network interface 317, a storage system 320, a printer system interface 321 and a video subsystem 325 and video display 326 for the server system 103, which are all coupled to the system bus 303. The input interface allows a system administrator to input information into predetermined data bases and the parking system application running on the server system 103.

FIG. 4 shows an exemplary schedule database which is implemented to accomplish scheduled and/or selected parking slot restriction changes in accordance with the present invention. As illustrated, the variables may designate a particular day such as "Apr. 4, 2005", along with the parking designations for the various parking slots at various times throughout the day. In one embodiment, an administrator may change or input changes to the scheduled restrictions and apply the new times or restrictions by pointing to and clicking on one of several actions to be taken with regard to the input changes. As illustrated at the bottom of the display screen, an administrator may immediately APPLY SCHEDULED RESTRICTIONS, or EXIT AND APPLY A DEFAULT SCHEDULE, or EXIT WITHOUT APPLYING CHANGES. The schedule illustrated in FIG. 4 may be typical for a restaurant where a minimum of two handicapped spaces, e.g. P4-P5, are designated at any given time. At certain times during the day, such as during breakfast (0430-0900) and dinner hours (1900-0000), the number of short-term parking spaces is increased to encourage a faster turnover of spaces to accommodate more patrons. Also shown in the example is an input to designate reserved spaces and/or change time limits for short-term parking. Another input enables an administrator to indicate whether or not to sound an alarm if any vehicle exceeds an allowed time limit. The alarm may be audible only, or visual only (e.g. flashing lights on the parking slot display) or both. Further, the alarm may simply provide a parking slot number and/or vehicle license plate to the administrator to take further action as determined by restaurant policies. An alarm may also cause a signal to be sent to a location to log the event and related pertinent data. The alarm may also trigger actions such as a notification to the police.

FIG. 5 illustrates an exemplary server display screen 501 which is used to provide a concise display of the current status of a controlled parking lot. In one portion of the display 503, a vehicle icon illustration shows which slots are currently occupied by vehicles. The display also shows, for each designated parking space P1-P4, what the current parking designation is, such as unrestricted or "UR", "Short-Term" or "Handicapped". The example also shows whether the vehicle in the occupied slots are authorized or still within a designated short-term parking time period, and/or whether an alarm (in any form) has been activated.

Figure 6:
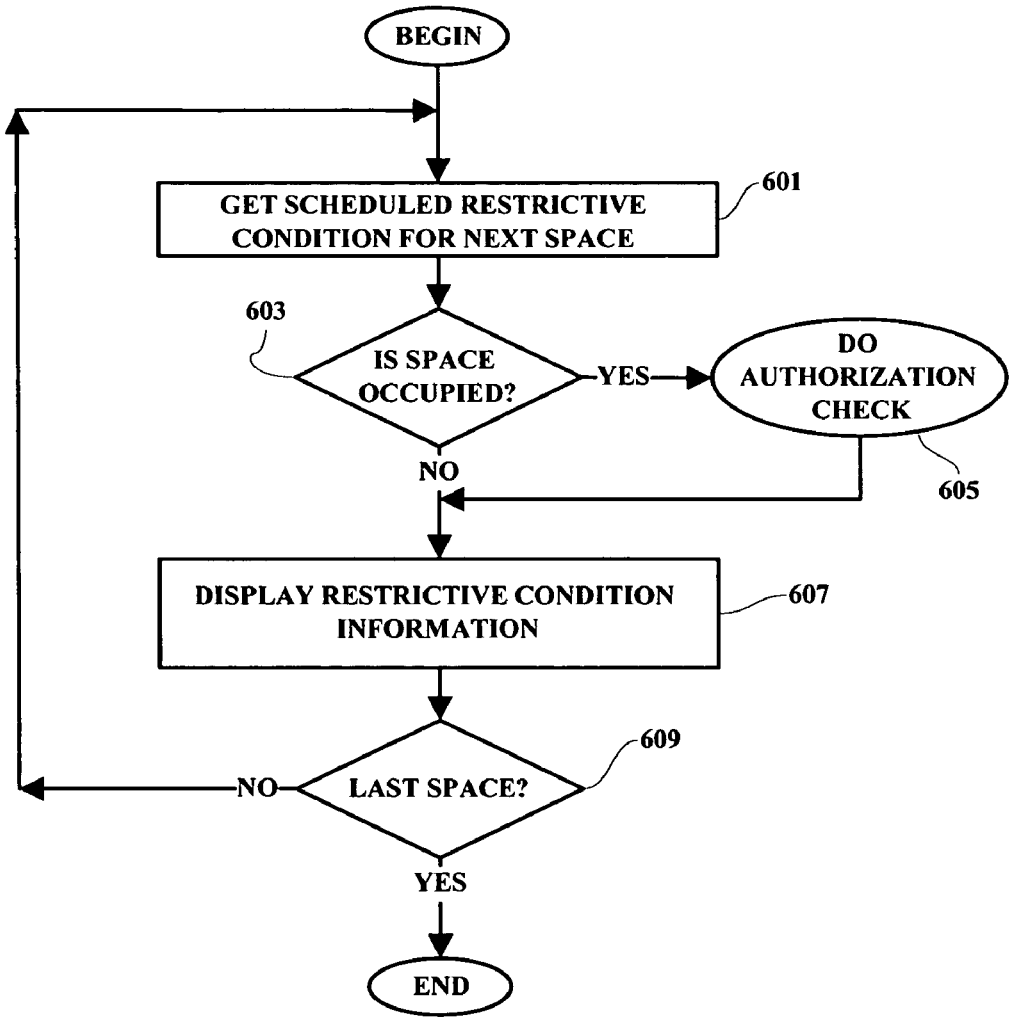
FIG. 6 is a flowchart showing an exemplary operation of a controlled parking system in accordance with the present invention.

FIG. 6 illustrates an exemplary sequence for a parking space scanning operation. As shown, after accessing the database or schedule to get a scheduled restrictive condition for a given parking space 601, it is determined whether or not the space being scanned is occupied by a vehicle 603. If so, an authorization process 605 is performed. If not, the appropriate restrictive information is caused to be displayed 607 at the parking space display device and this process is repeated until all of the spaces have been scanned 609 at which time the process ends. This process may be implemented on an ongoing continuous basis or on a periodic selective basis.

Figure 7:
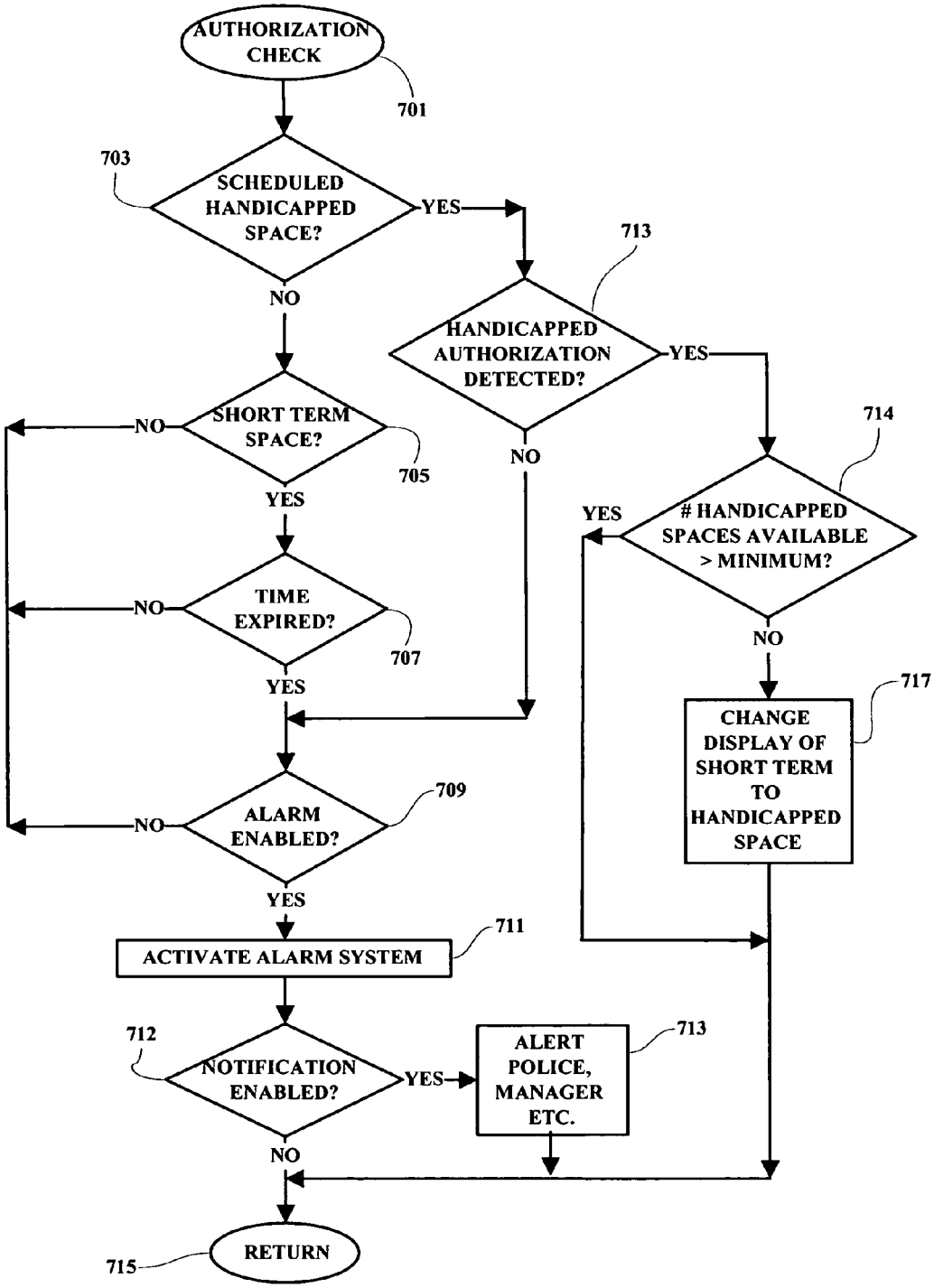
FIG. 7 is flowchart showing an exemplary authorization routine which may be implemented in accordance with the present invention.

An exemplary authorization check 701, as shown in FIG. 7, includes determining whether a space being scanned is a handicapped space 703. If the space is not a handicapped space 703, then a check is made to determine if the space is a short-term parking space 705. If the space is a short-term parking space, a check is made to determine if the allowed time for the parked vehicle has expired 707 and if so, whether or not the designated alarm input has been enabled 709. If the alarm has been enabled 709 according to the value stored in the parking schedule (FIG. 4), then the alarm system is activated 711. A check is then made to determine if any special notifications are required 712 such as a police notification or a management notification. If any notifications are enabled, such notifications are made 713 and the process returns 715 to block 607 in FIG. 6. If the scanned space is a handicapped space 703, a check is made 713 to determine if an appropriate handicap authorization is detected on the vehicle. If proper authorization has been detected 713, then another check is made 714 to determine that the number of remaining unoccupied handicapped slots is still greater than a minimum number as may be required by city ordinance or enterprise policy. If there are a sufficient number of handicapped spaces still available 714, the processing returns 715 to block 607. If the number of handicapped spaces has dropped below the minimum number 714, then the designation of one of the available "Short-Term" spaces is changed 717 to "Handicapped" before the process returns to scan the next space.

In one exemplary embodiment of the present invention, electronically detectable tags (such as radio frequency identification tags or "RFID" tags) are used to discriminate between authorized and authorized vehicles. In the example, the parking system utilizes RFID, License Plate scans, bar code scans or other scans to identify authorized and/or unauthorized vehicles. The system may be implemented to automatically call law enforcement and/or initiate towing procedures, and in some cases issue citations. Other means may also be implemented to encourage drivers not to use such reserved parking spots such as handicapped zones, fire lanes, or other restricted areas. In addition, the system incorporates a set of designated parking spaces with variable attributes such that any specified parking space could be, for example, designated as a handicapped space, a fire lane, or a short-term, 15-minute parking slot.

For purposes of illustration, a parking entity might designate a set of 20 parking spaces close to a building as being short-term (courier/delivery-only, 15 minute limit, etc.) and handicapped parking spaces. When these parking spaces are all empty, 15 of them may be sign-designated as short-term slots and the remaining 5 are sign-designated as handicapped spaces. Electronically (or other) variable signs, or wireless displays on an operator hand-held device for example, would inform motorists of the current attribute of any of the 20 reserved spaces along with any warning or penalty information deemed suitable for the circumstances. For example, a government ordinance or building management policy may require at least two open handicapped spaces at all times. During the course of the day, as vehicles move in an out of the designated twenty slots, the system would detect via RFID, License plate, OCR, bar code, or other scans, whether a vehicle entering one of the slots was authorized (i.e., a designated handicapped vehicle) to reside in any particular slot. Non-handicapped designated vehicles stopping in reserved, signed handicapped slots would trigger, after scanning, a notification mechanism to selectively sound an alarm or alert management, towing, police, or other authorities of the parking violation. Management policy can dictate exception for official, emergency, and other vehicles moving into or over-staying reserved slots. Non-handicapped designated vehicles stopping in reserved short-term slots would begin a count-down timer. Actions in response to expiring timers would be left to building management.

Handicapped vehicles entering and leaving handicapped slots would cause the system to compute a running tally of the number of reserved slots occupied and the number remaining available. In this example, when the first marked handicap slot becomes occupied, the system would immediately change the attribute sign of an available, open, short-term parking space to handicapped status in order to maintain the minimum of two available handicap positions. If there are no open short-term slots, the system could begin a 15 minute count down on any one, some, or all of the short-term slots. Alternatively, the system could determine which short-term slot had been occupied longest and either count from down the minutes remaining (which could be zero) or begin a 15 minute count down.

If a vehicle in a targeted short-term slot exits before time the 15 minute count down expires, the vacated slot's attribute sign would immediately change from "short-term" to "handicapped". This would bring the number of vacant handicapped slots back up to a minimum of 2. If a vehicle vacates a different short-term slot in the reserved set, the system can immediately change its attribute sign from "short-term" to "handicapped" and either reset of continue the 15 minute count down in the previously targeted slot. At the end of the count down on a targeted, occupied short-term slot, the system determines if it is still occupied by the now over-limit vehicle. If the targeted short-term slot is still occupied, building management can determine what action to take, such as broadcasting to building occupants or having the vehicle towed. If the targeted short-term slot has been vacated, the attribute sign changes from "short-term" to "handicapped".

There are many variations on the proposal above. But the key point among them is that a unified system can vary the number of handicapped or other restricted parking spaces to ensure that they are available to those who need them the most without needlessly tying up parking space when it is not needed.

In an exemplary implementation, a display device (e.g. 111-119) is installed at each parking space in the pavement or on a post, which detects the presence of a vehicle. When a vehicle moves into this spot, it reads (using short range signals) the RFID on the license plates (or handicap sticker/sign) and determines if it is the appropriately allowed vehicle in the spot, for example someone with a handicap or an emergency vehicle. If the vehicle is not authorized to park there, various actions can be taken, including towing and notifying the police. In the case that the vehicle is not equipped with an RFID license plate or sticker, the system can scan the existing license plate. This scan can be examined for a suitable handicap logo or other identification symbol or even bar-code or general character scan to determine if the vehicle may be permitted to park there. In any case, the scanned plate image is forwarded to a central ticket office for double checking. The double check would determine if the scanned plate may be a forgery or modified with a stick-on handicap symbol. The central ticket office could call for a police officer to go there and personally examine the situation and the office may also call for a towing vehicle to go to that location to tow the vehicle away. If the license plates for the particular state all have RFIDS, then an automatic parking citation can be issued to the registered owner of the vehicle. Otherwise the central ticket office can use the scanned plate image to identify the owner and issue a citation.

The process can be extended to parking rights in an apartment complex, for example. Any unauthorized vehicles in reserved spaces would be immediately reported and towed. An additional step might be provided to allow apartment residents to temporarily permit guests to park in their own or "guest" spaces. As described in the section above, the system can dynamically allocate parking spaces for varying purposes from a pool by detecting the presence of properly tagged vehicles and adjusting the parking space allocations to ensure that particular types of empty spaces are always or quickly made available.

The method and apparatus of the present invention has been described in connection with a preferred embodiment as disclosed herein. The disclosed methodology may be implemented in a wide range of sequences to accomplish the desired results as herein illustrated. Although an embodiment of the present invention has been shown and described in detail herein, along with certain variants thereof, many other varied embodiments that incorporate the teachings of the invention may be easily constructed by those skilled in the art, and even included or integrated into a processor or CPU or other larger system integrated circuit or chip. The disclosed methodology may also be implemented solely or partially in program code stored on a CD, disk or diskette (portable or fixed), or other memory device, from which it may be loaded into memory and executed to achieve the beneficial results as described herein. Accordingly, the present invention is not intended to be limited to the specific form set forth herein. On the contrary, it is intended to cover such alternatives, modifications, and equivalents, as can be reasonably included within the spirit and scope of the invention.

What is claimed is:

1. A method for enabling management of restricted parking spaces for vehicles, said method comprising:

providing a display of a parking restriction indicium, said display being viewable by a driver of a vehicle, said parking restriction indicium being representative of a first restrictive status of said parking spaces, said display being controlled by a server located remotely from said display;

detecting a number of said parking spaces occupied by vehicles; and enabling said server to initiate a selective changing of said parking restriction indicium from said first restrictive status to a second restrictive status for selected ones on said parking spaces when a predetermined number of parking spaces are occupied by vehicles.

2. The method as set forth in claim 1 wherein said first restrictive status permits only parking by vehicles having a handicapped designation.

3. The method as set forth in claim 2 wherein said second restrictive status permits only parking for designated short term periods of time.

4. The method as set forth in claim 1 wherein said first restrictive status permits only parking for designated short term periods of time.

5. The method as set forth in claim 4 wherein said second restrictive status permits only parking by vehicles having a handicapped designation.

6. The method as set forth in claim 1 wherein said selective changing is accomplished by a server system in accordance with a scheduled parking plan stored in memory of said server system.

7. The method as set forth in claim 1 wherein said selective changing is accomplished by providing input to a scheduled parking plan stored in memory of said server system.

8. The method as set forth in claim 1 wherein said display comprises a display presented on a wireless display device within a vehicle.

9. The method as set forth in claim 1 wherein said display device is an electronically controlled display device located in proximity to said predetermined parking space.

10. The method as set forth in claim 9 and further including a sensing means operable for sensing a presence of a vehicle in said predetermined parking space.

11. The method as set forth in claim 10 wherein said sensing means is included within said display device.

12. The method as set forth in claim 10 wherein said sensing means is physically separate from said display device.

13. A method for enabling management of restricted parking spaces for vehicles, said method comprising:

providing a display of a parking restriction indicium, said display being viewable by a driver of a vehicle, said parking restriction indicium being associated with a predetermined vehicle parking space, said parking restriction indicium being representative of a first restrictive status of said predetermined parking space;

enabling a selective changing of said parking restriction indicium from said first restrictive status to a second restrictive status for said predetermined parking space from a location removed from said predetermined vehicle parking space, wherein said display device is an electronically controlled display device located in proximity to said predetermined parking space, and further including a sensing means operable for sensing a presence of a vehicle in said predetermined parking space;

determining a minimum number of parking spaces to be reserved as handicapped or other restricted parking categories;

sensing a presence of a vehicle in a handicapped or other restricted parking space; and automatically changing a parking restriction indicium of a non-handicapped or other restricted parking space to a parking restriction indicium representative of a handicapped or other restricted parking space when available parking spaces designated as handicapped or other restricted parking spaces falls below said minimum number.

14. A method for enabling management of restricted parking spaces for vehicles, said method comprising:

providing a display of a parking restriction indicium, said display being viewable by a driver of a vehicle, said parking restriction indicium being associated with a predetermined vehicle parking space, said parking restriction indicium being representative of a first restrictive status of said predetermined parking space; enabling a selective changing of said parking restriction indicium from said first restrictive status to a second restrictive status for said predetermined parking space from a location removed from said predetermined vehicle parking space;

monitoring said predetermined vehicle parking space for compliance with said parking restriction indicium; and providing a perceptible indication when a violation of said parking restriction condition applicable to said predetermined vehicle parking space is detected.

15. The method as set forth in claim 14 wherein said perceptible indication is provided at a display device of a server system.

16. The method as set forth in claim 14 wherein said perceptible indication is provided by a visual or audio alarm system at a display device located proximate to said predetermined parking space.

17. A method for enabling management of restricted parking spaces for vehicles, said method comprising:

providing a display of a parking restriction indicium, said display being viewable by a driver of a vehicle, said parking restriction indicium being associated with a predetermined vehicle parking space, said parking restriction indicium being representative of a first restrictive status of said predetermined parking space;

enabling a selective changing of said parking restriction indicium from said first restrictive status to a second restrictive status for said predetermined parking space from a location removed from said predetermined vehicle parking space; detecting a presence of an authorization signal from a vehicle in said predetermined vehicle parking space, said authorization signal being representative of an authorization to park in predetermined ones of said restricted parking spaces; and processing said authorization signal for compliance with a restrictive status associated with a parking restriction indicium for said predetermined vehicle parking space.

18. The method as set forth in claim 17 wherein said authorization signal is provided by a radio frequency identification (RFID) device on said vehicle.

19. A storage medium including machine readable coded indicia, said storage medium being selectively accessed by a computer system to provide program signals representative thereof, said program signals being selectively operable within said computer system for enabling management of restricted parking spaces for vehicles by effecting the steps of:

providing a display of a parking restriction indicium, said display being viewable by a driver of a vehicle, said parking restriction indicium being representative of a first restrictive status of said parking spaces, said display being controlled by a server located remotely from said display;

detecting a number of said parking spaces occupied by vehicles; and enabling said server to initiate a selective changing of said parking restriction indicium from said first restrictive status to a second restrictive status for selected ones on said parking spaces when a predetermined number of parking spaces are occupied by vehicles.

20. A processing system for enabling management of restricted parking spaces for vehicles, said processing system comprising:

a system bus;

a CPU device connected to said system bus;

a memory connected to said system bus;

means for detecting a number of said parking spaces occupied by vehicles; and display means viewable from a predetermined parking space, said display means being operable for providing a display of a parking restriction indicium, said parking restriction indicium being representative of a first restrictive status of said parking spaces, said processing system being located remotely from said parking spaces, said processing system being operable for enabling a selective changing of said parking restriction indicium on said display means from said first restrictive status to a second restrictive status for selected ones on said parking spaces when a predetermined number of parking spaces are occupied by vehicles.

* * * * *